US006196449B1

(12) United States Patent
Chen

(10) Patent No.: US 6,196,449 B1
(45) Date of Patent: Mar. 6, 2001

(54) PARTITION FOR A BOX

(76) Inventor: Chao-Te Chen, 4th Fl., No. 385, Sec. 2, Huan-Ho N. Rd., Ta-Tung Dist., Taipei (TW)

( * ) Notice: Subject to any disclaimer, the term of this patent is extended or adjusted under 35 U.S.C. 154(b) by 0 days.

(21) Appl. No.: 09/618,923

(22) Filed: Jul. 18, 2000

(51) Int. Cl.[7] ..... B65D 5/491

(52) U.S. Cl. ..... 229/120.31; 229/120.26; 229/120.29

(58) Field of Search ..... 229/120.24, 120.26, 229/120.29, 120.31, 120.37

(56) References Cited

U.S. PATENT DOCUMENTS

| | | | | |
|---|---|---|---|---|
| 3,101,652 | * | 8/1963 | Imieliski | 229/120.31 |
| 3,515,036 | * | 6/1970 | Oki et al. | 229/120.24 |
| 3,715,072 | * | 2/1973 | Muskopf et al. | 229/120.37 |
| 3,834,074 | * | 9/1974 | Shirouzu | 229/120.31 |
| 4,470,539 | * | 9/1984 | Skillen | 229/120.26 |
| 4,951,867 | * | 8/1990 | McManus | 229/120.31 |
| 5,004,146 | * | 4/1991 | Thominet et al. | 229/120.31 |
| 5,379,945 | * | 1/1995 | Kataoka | 229/120.37 |
| 5,429,243 | * | 7/1995 | Woelk et al. | 229/120.26 |

FOREIGN PATENT DOCUMENTS

| | | | | |
|---|---|---|---|---|
| 1395153 | * | 3/1965 | (FR) | 229/120.31 |
| 40/5294339 | * | 11/1993 | (JP) | 229/120.31 |

* cited by examiner

*Primary Examiner*—Gary E. Elkins
(74) *Attorney, Agent, or Firm*—William E. Pelton, Esq.

(57) ABSTRACT

A partition for a box includes at least two flat walls, at least one corrugated wall, and a baseboard. The corrugated wall has a plurality of alternating box-like formations. The baseboard has two central portions symmetrically separated by a first folding line, two opposed outer flaps, and two opposed end flaps. Combined rows of flat and corrugated walls are adhered to inner faces of the outer flaps by outer faces of the outermost flat walls. The combined baseboard, corrugated walls and flat walls can be folded to a very compact state by folding the baseboard about the first folding line such that the corrugated and flat walls are compressed.

9 Claims, 6 Drawing Sheets

PARTITION FOR A BOX

BACKGROUND OF THE INVENTION

1. Field of the Invention

The invention relates to a partition for a box, and more particularly, a partition which provides a plurality of compartments when fitted in a box and which can be conveniently folded flat when not required.

2. Description of Related Art

Boxes are often compartmentalized with partitions so that items stored therein can be kept separate whereby the items can easily be removed, counted, or inspected etc., individually. Furthermore, the items are protected well individually from damage and so corresponding losses are minimized. Contamination from one item, such as delicate fruit, to another, is reduced and easily detectable should it occur when this type of box compartmentalization is used. Referring to FIG. 6, a box with a conventional partition (90) is shown. The partition (90) comprises a series of first strips (92) fitted parallel to each other at regular intervals in a frame, and a series of second strips (94) fitted in the frame and perpendicular to the first strips (92). Each of the first strips (92) has a plurality of slots (920) extending upward from a bottom edge thereof. Each of the second strips (94) has a plurality of slots (940) corresponding to the slots (920) and extending downward from a top edge thereof. The first and second strips (92, 94) each are respectively slotted together by respectively mating the slots (920, 940) such that a plurality of compartments within the frame is formed, and the partition (90) can then be fitted in a box. Although the partition (90) performs satisfactorily when in use, if it has to be stored it is too slow and difficult to reduce to a compact size and so a great deal of space may be occupied when many of such partitions have to be stored. High land values mean that it is very expensive to use factory space so inefficiently with this type of partition. Thus, there is a long and unfulfilled need for a partition for a box which can be folded flat easily and conveniently whereby a minimum of storage space is occupied when the partition is not in use.

SUMMARY OF THE INVENTION

The main objective of the invention is to provide a partition for a box wherein the partition can be folded flat easily and conveniently when not being used to contain items, that a minimum of storage space for such partitions is occupied.

Other objects, advantages and novel features of the invention will become more apparent from the following detailed description when taken in conjunction with the accompanying drawings.

DETAILED DESCRIPTION OF THE PREFERRED EMBODIMENT

Figure 1:
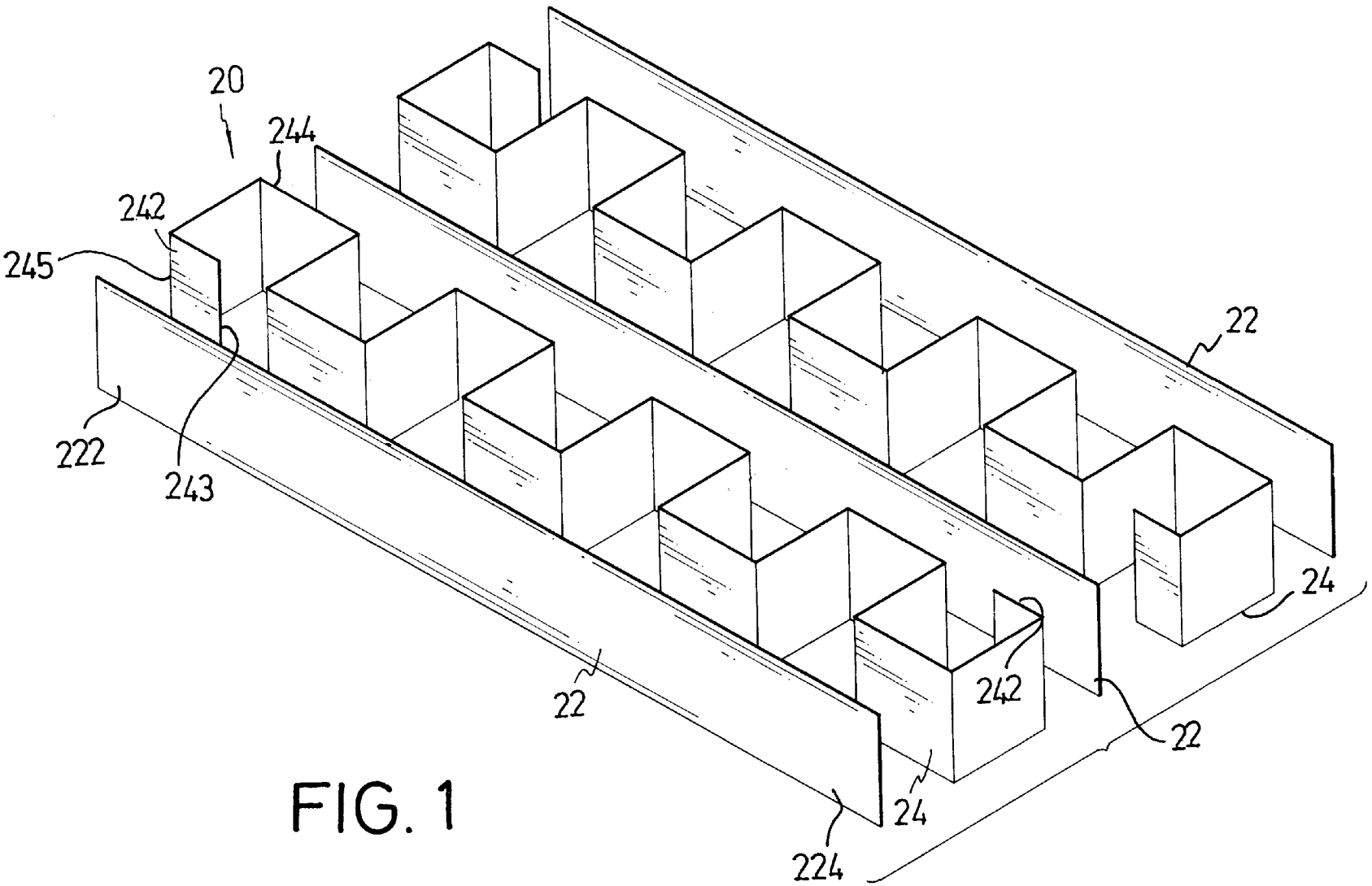
FIG. 1 is a perspective view of a first wall and a second wall of a box partition in accordance with the present invention.
Figure 2:
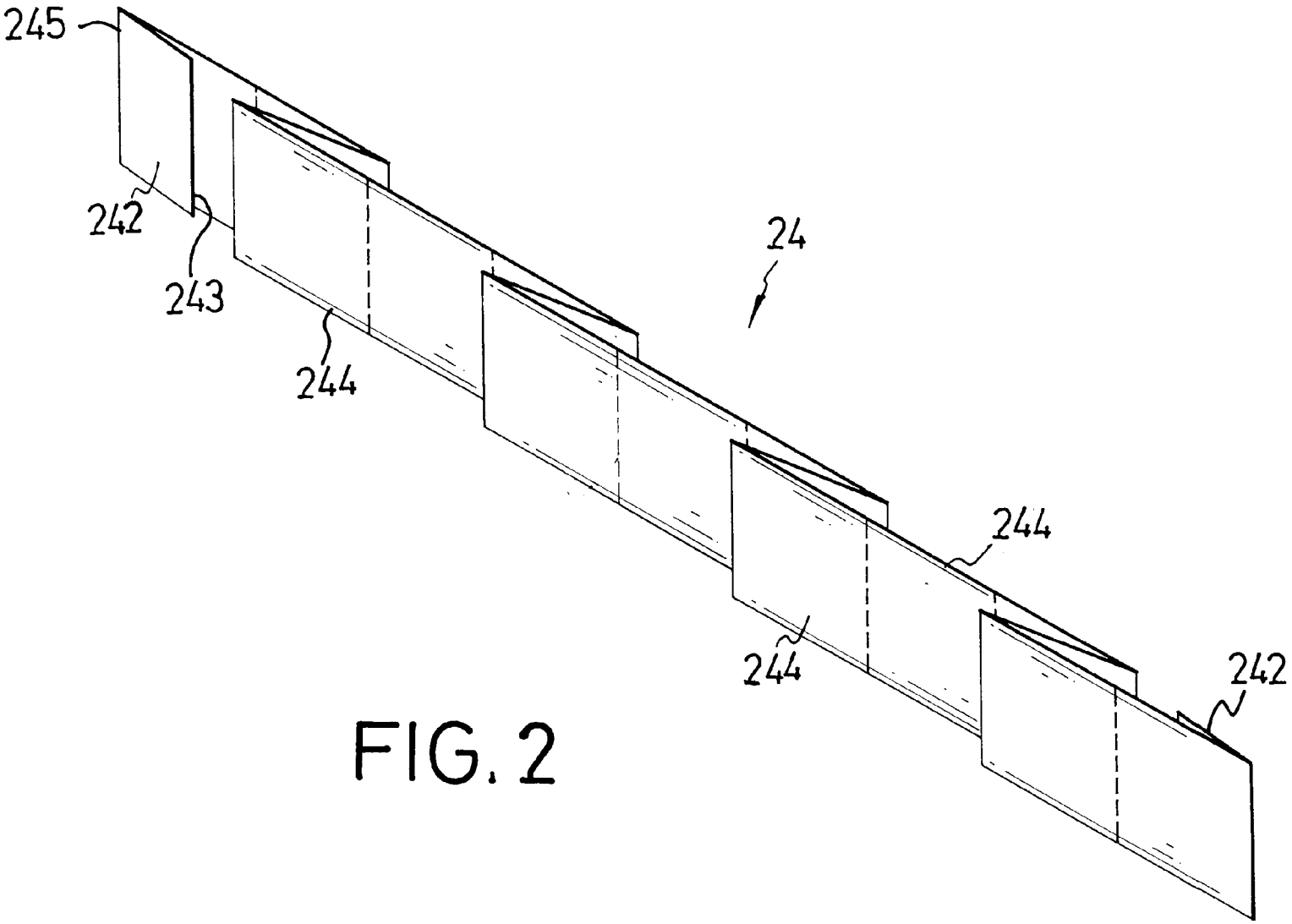
FIG. 2 is a perspective view of a first wall of the partition shown in FIG. 1.
Figure 4:
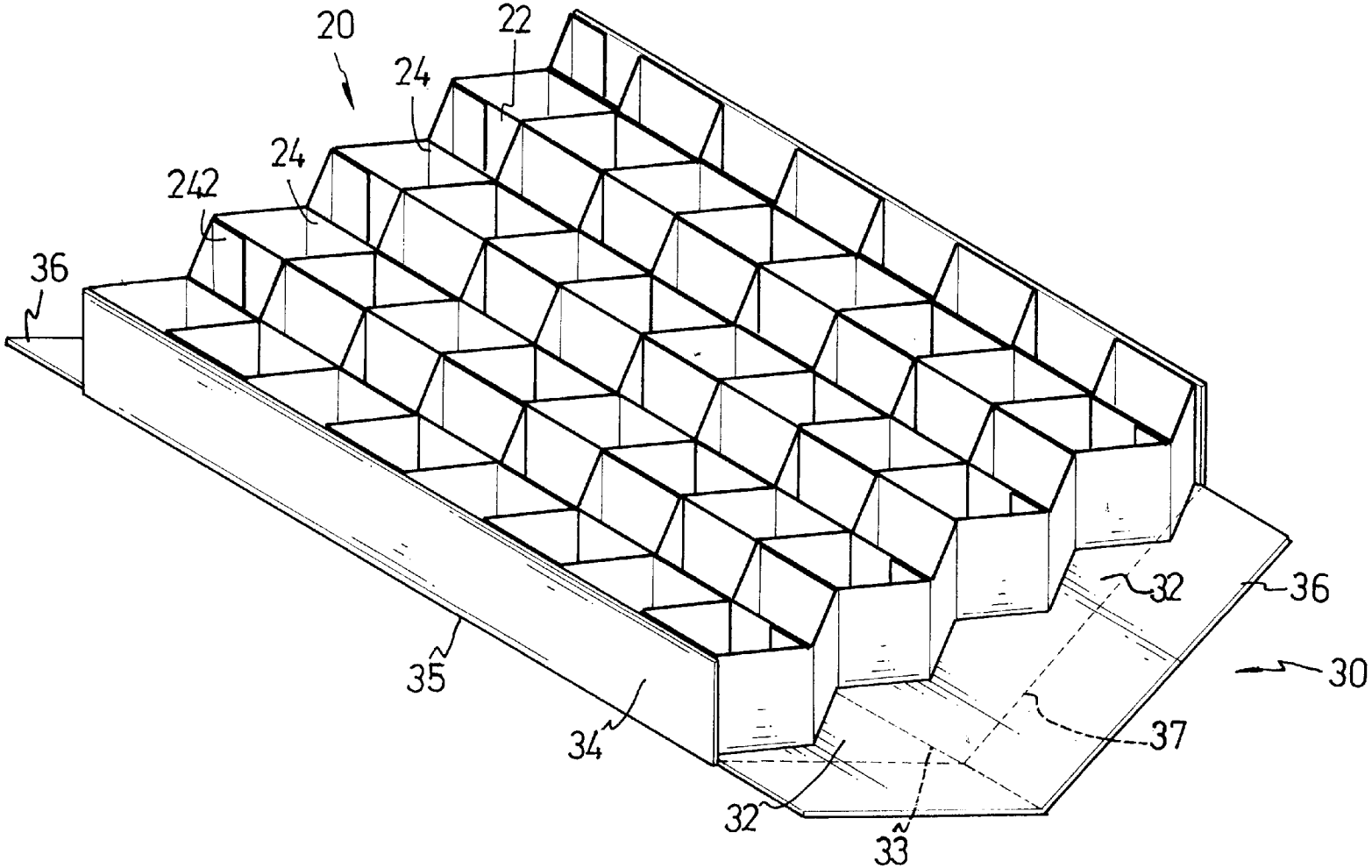
FIG. 4 is a perspective view of the partition of the present invention, and in a partly opened condition.

Referring to FIGS. 1 and 4, a partition for a box in accordance with the present invention includes an upright portion (20) with at least two flat walls (22), at least one corrugated wall (24), and a baseboard (30). Each flat wall (22) has a front end (222) and a rear end (224). The corrugated wall (24) comprises a series of alternating box-like formations each with three straight sides (244) of equal length. Referring to FIGS. 1 and 2, the three straight sides (244) of each box-like formation define an open end and a closed end. Front and rear ends of the corrugated walls (24) each have a short tab (242) with a distal edge (243) and ajunction edge (245). Each short tab (242) is formed parallel to a respective one of the flat walls (22) and the junction edges (245) thereof align with the respective front and rear ends (222, 224) of the flat walls (22), with the distal edges (243) of the short tabs (242) terminating on the corresponding flat wall (22) near either the front or rear end (222, 224) thereof, to define the open end of the respective box-like formation. Referring to the front end of the corrugated wall (24), a first of the three straight sides (244) extends at the junction edge (245) of the short tab (242) perpendicularly away therefrom. A second of the straight sides (244) extends perpendicularly away from the first straight side (244) and parallel to the short tab (242), to define the closed end of this box-like formation. The third straight side (244) extends perpendicularly away from the second straight side (244) and aligns with the first straight side (244). The third straight side (244) simultaneously forms a first straight side (244) of the following box-like formation which is the same as the preceding box-like formation apart from the open and closed ends being formed at positions opposite thereto. The series of alternating box-like formations is repeated in accordance with the box into which the upright portion (20) is to be fitted. Although in this embodiment the straight sides (244) are of the same length, it is to be appreciated that in particular the first and third straight sides can be of a same length but of a different length to the second straight side (244). Referring to FIG. 1, two of the corrugated walls (24) are shown and the respective open ends of the formations align therebetween.

Referring to FIG. 2, a folded corrugated wall (24) is shown to illustrate the sequence of folds. The short tab (242) at the front end is folded in toward the first straight side (244). The third straight side (244) of the first box-like formation, which also functions as the first straight side (244) of the second box-like formation, is folded towards the preceding and following second side walls (244). Subsequently, every fourth straight side (244) is folded at junction edges thereof to abut the preceding and following straight sides (244). The short tab (242) at the rear end is folded at its junction edge to abut the preceding straight side (244) but in an opposite direction to the other short tab (242).

Figure 3:
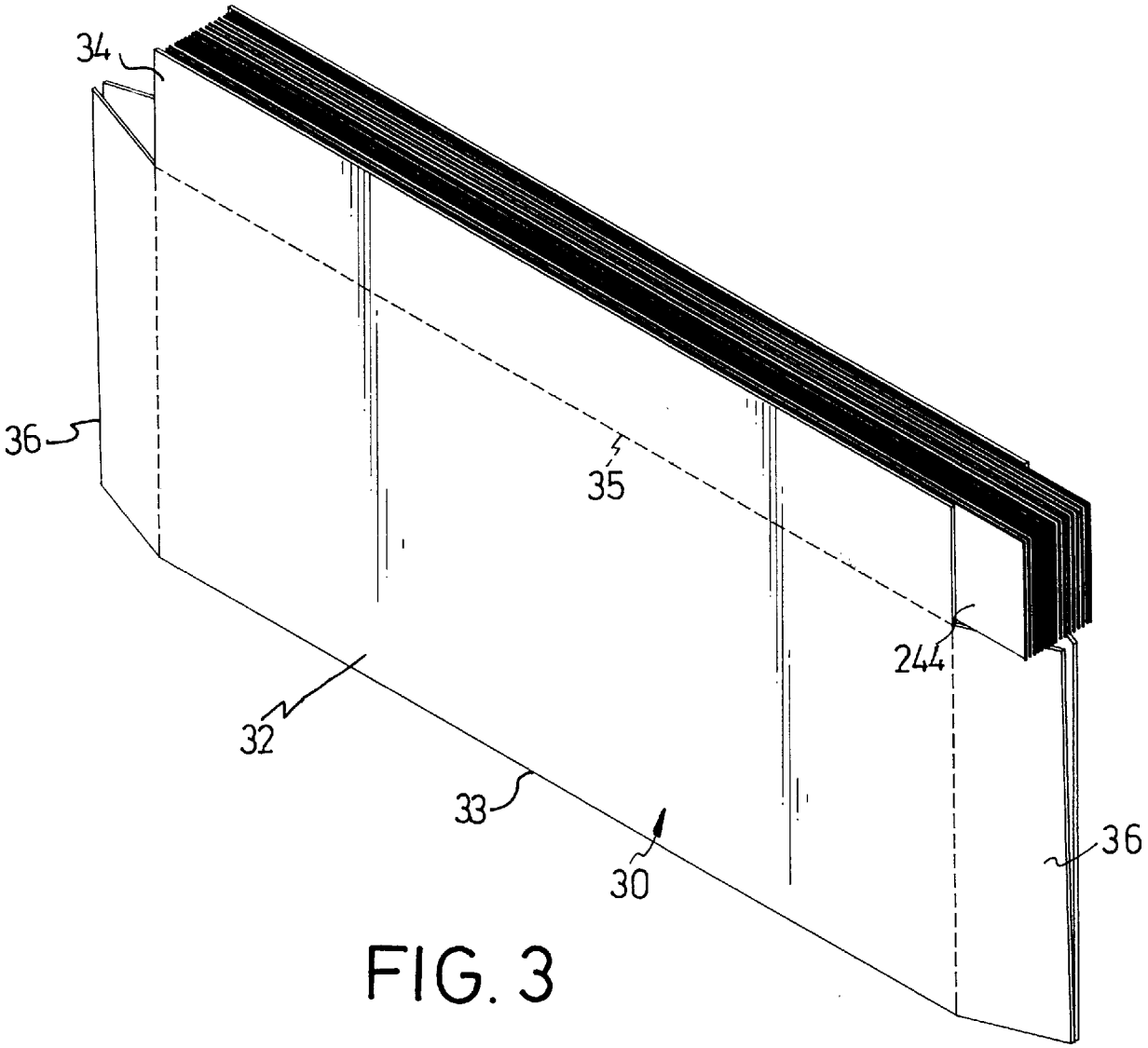
FIG. 3 is a perspective view of the partition of the present invention, and in a folded condition.

Referring to FIGS. 3 and 4, the baseboard (30) includes two symmetrical central portions (32) separated by a first folding line (33), two opposed outer flaps (34) respectively joining outer longitudinal edges of the central portions (32) at corresponding second folding lines (35), and two opposed end flaps (36) respectively joining lateral edges of the central portions (32) at corresponding third folding lines (37). The first folding line (33) extends to distal edges of the end flaps (36).

Figure 5:
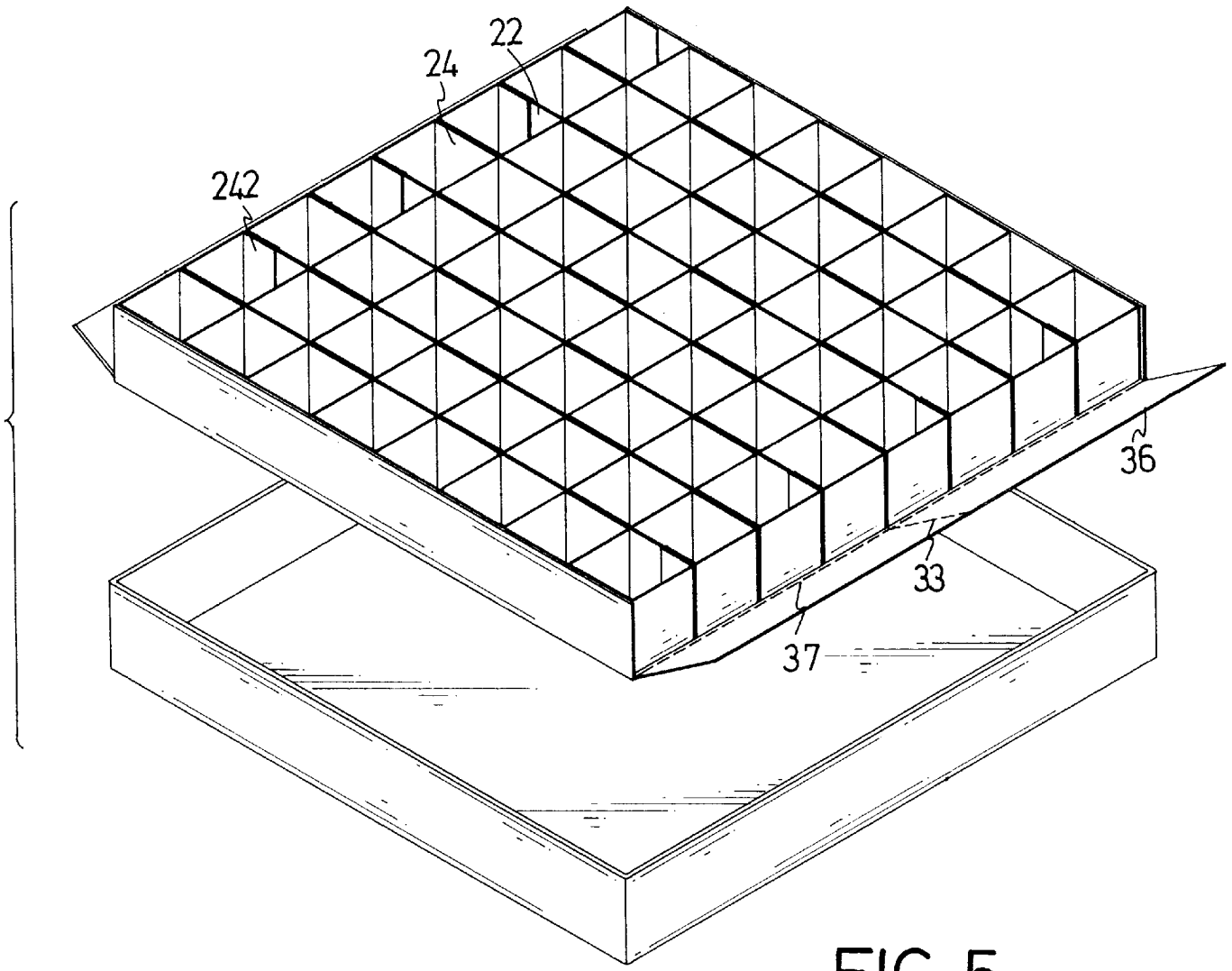
FIG. 5 is a perspective view of the partition of the present invention in a fully opened condition and prior to insertion in a box.
Figure 6:
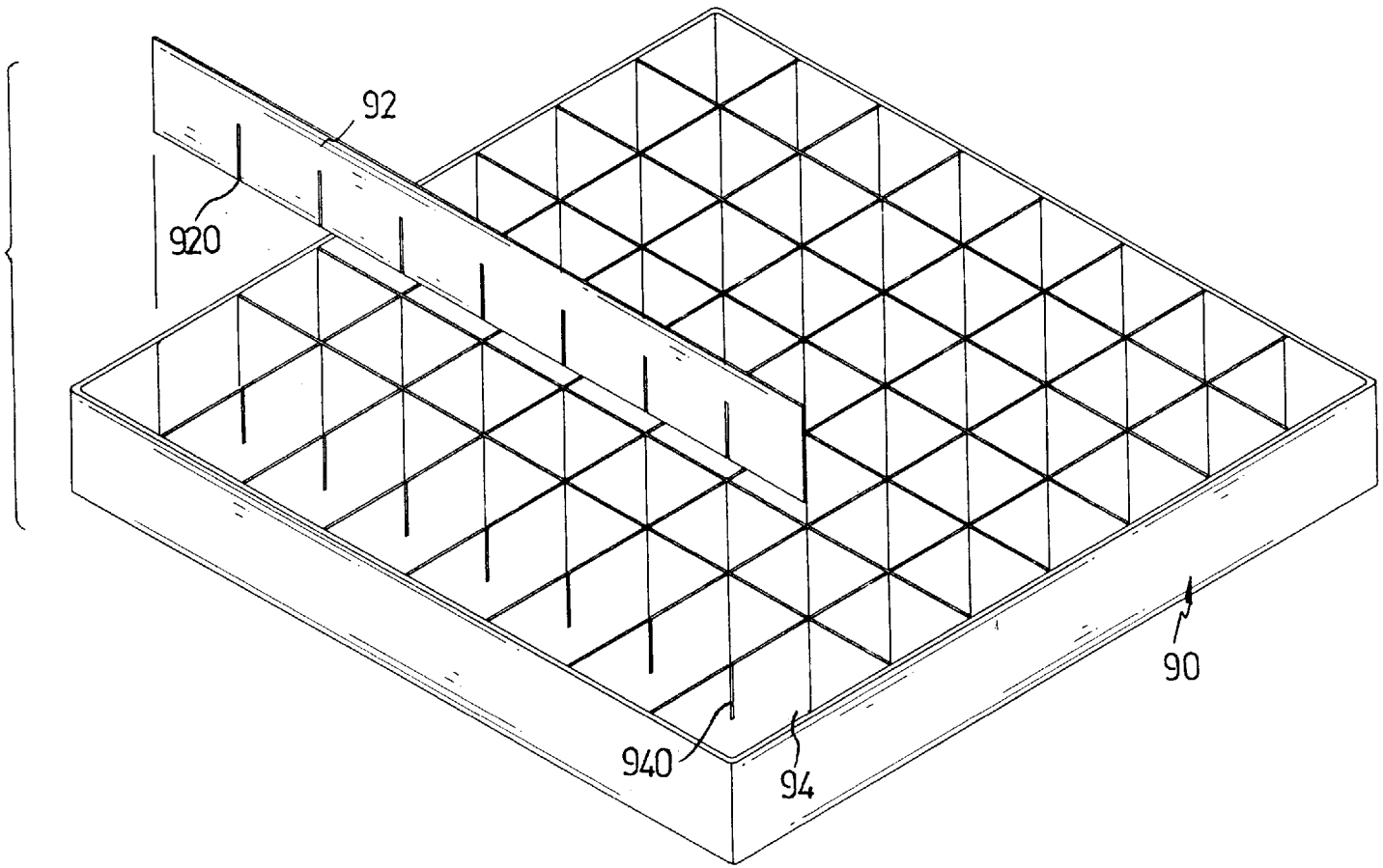
FIG. 6 PRIOR ART
FIG. 6 is a perspective view of a prior art partition.

In assembly, referring to FIGS. 4 and 5, a plurality of the flat and corrugated walls (22, 24) are mounted to a top face of the baseboard (30). Flat walls (22) are adhesively sandwiched between closed and open ends of corresponding corrugated walls (24). Outermost corrugated walls (24) are adhered to an inner face of a respective one of the flat walls (22), and outer faces of those outermost flat walls (22) are adhered to an inner face of the respective outer flap (34).

Referring particularly to FIG. 3, the baseboard (30) is folded about the first folding line (33) such that the flat and corrugated walls (22, 24) are compressed in the sequence described earlier in reference to FIG. 2.

In reference to FIG. 4, the partition is partly opened, clearly illustrating that the corrugated walls (24) are adhered to the flat walls (22) of the baseboard (30) by only the closed ends of the box-like formations.

In reference to FIG. 5, the partition is shown in its opened condition prior to insertion in a box (40), with the end flaps (36) being raised about the third folding lines (37).

The first, second and third folding lines (33, 35, 37) may be formed while the baseboard (30) is folded only and without preparation, or as a series of perforations, or as score marks, or as permutations of the three aforementioned manners.

The partition of the present invention has the following advantages:

1. convenience. The partition can be folded quickly and easily without any skill, and then be opened out again with the same speed and ease.
2. compactness. Although the partition has the same extended size as a conventional partition for a box, it folds down to a compact size far smaller than the conventional partition.
3. Variety. The first, second and third folding lines can be formed without preparation, as perforated lines, as score lines, or as permutations of the aforementioned.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A partition for a box, comprising:

at least two flat walls each with a front end and a rear end;

at least one corrugated wall having a front end and a rear end respectively aligning with the front and rear ends of the at least two flat walls, and including a plurality of alternating open and closed ends, and two short tabs respectively formed at the front and rear ends of the corrugated wall; and a baseboard including two symmetrical portions, two opposed outer flaps respectively formed on outer longitudinal peripheries of the symmetrical portions, and two end flaps formed on outer lateral peripheries of the symmetrical portions;

wherein alternating rows of the flat walls and corrugated walls are securely retained on a top face of the baseboard and between the outer flaps, whereby the partition can extend between a flat folded condition for storage and an open condition for insertion in a box requiring compartmentalization.

2. The partition as claimed in claim 1, wherein the baseboard includes a first folding line separating the symmetrical portions such that the partition can be easily folded to sandwich flat walls and the corrugated walls therebetween.

3. The partition as claimed in claim 2, wherein the first folding line is a series of perforations in the top face of the baseboard.

4. The partition as claimed in claim 2, wherein the first folding line is a scored line in the top face of the baseboard.

5. The partition as claimed in claim 1, wherein outer faces of the closed ends of the corrugated walls are adhered to respective flat walls, and outermost flat walls are adhered to respective inner faces of the outer flaps of the baseboard.

6. The partition as claimed in claim 1, wherein two second folding lines are respectively formed between the symmetrical portions and the corresponding outer flap, whereby the outer flaps can be folded easily.

7. The partition as claimed in claim 6, wherein the second folding lines are each a series of perforations in the top face of the baseboard.

8. The partition as claimed in claim 1, wherein two third folding lines are respectively formed between the symmetrical portions and the corresponding end flap, whereby the end flaps can be folded easily.

9. The partition as claimed in claim 8, wherein the third folding lines are each a series of perforations in the top face of the baseboard.

* * * * *